US006779976B1

(12) United States Patent
Carfagna et al.

(10) Patent No.: US 6,779,976 B1
(45) Date of Patent: Aug. 24, 2004

(54) METHOD FOR REMOVING POLLUTANTS FROM THE AIR AND APPARATUS THEREFOR

(76) Inventors: Nancy A. Carfagna, 4623 Summerbridge Cir., Leesburg, FL (US) 34748; Paul D. Carfagna, 4623 Summerbridge Cir., Leesburg, FL (US) 34748

( * ) Notice: Subject to any disclaimer, the term of this patent is extended or adjusted under 35 U.S.C. 154(b) by 99 days.

(21) Appl. No.: 10/272,181

(22) Filed: Oct. 16, 2002

Related U.S. Application Data

(60) Provisional application No. 60/361,496, filed on Mar. 5, 2002.

(51) Int. Cl.[7] ..... F04D 29/70

(52) U.S. Cl. ..... 416/5; 416/62; 416/146 R; 55/385.1; 95/78; 96/63; 422/121

(58) Field of Search ..... 416/5, 62, 146 R; 55/385.1; 95/78, 277; 96/63, 97; 422/121, 122, 123, 124

(56) References Cited

U.S. PATENT DOCUMENTS

| | | | | | |
|---|---|---|---|---|---|
| 2,720,013 | A | * | 10/1955 | Clarke | 416/146 R |
| 4,676,721 | A | * | 6/1987 | Hardee | 416/146 R |
| D341,881 | S | * | 11/1993 | Smith et al. | D23/411 |
| 5,370,721 | A | * | 12/1994 | Carnahan | 416/62 |
| 5,383,765 | A | * | 1/1995 | Baxter et al. | 416/62 |
| 5,795,131 | A | * | 8/1998 | Crowhurst et al. | 416/146 R |
| 5,820,644 | A | * | 10/1998 | Mori et al. | 55/385.3 |
| 5,887,785 | A | * | 3/1999 | Yilmaz | 416/62 |

* cited by examiner

*Primary Examiner*—Edward K. Look
*Assistant Examiner*—Igor Kershteyn
(74) *Attorney, Agent, or Firm*—Ted Masters

(57) ABSTRACT

A method for removing pollutants from a gas such as air includes attaching a multi-layer stack of sheets to the surface of a fan blade. The sheets have a tacky surface disposed on their outward facing side, so that as the fan blade rotates pollutants are captured by the tacky surface. When the tacky surface of the top most sheet becomes contaminated with pollutants, it is peeled off to expose a clean uncontaminated next lower sheet.

10 Claims, 4 Drawing Sheets

METHOD FOR REMOVING POLLUTANTS FROM THE AIR AND APPARATUS THEREFOR

CROSS REFERENCE TO RELATED APPLICATION

This application claims the filing benefit under Title 35, United States Code, §119(e) of U.S. provisional application No. 60/361,496, filed Mar. 5, 2002.

TECHNICAL FIELD

The present invention pertains generally to air purification, and more particularly to a method and apparatus in which an attachment to a fan blade is utilized to remove pollutants from the air.

BACKGROUND OF THE INVENTION

Fans are commonly used to increase comfort by moving air and improving ventilation. Fans have been used in residential, institutional, and commercial facilities for many years and are manufactured by a number of companies worldwide. There exist a number of patents teaching the use of filters, or filter fasteners, blade covers or specifically designed blades to modify fans and/or their blades for capturing pollutants or foreign matter. For example, U.S. Pat. No. 6,174,340 shows a room air filter apparatus including a multi-sided housing having longitudinally spaced first and second ends, a plurality of sides between the first and second ends, and a plenum inside the housing. Each of the sides has an empty space frame by outer edges of the housing side. A fan is mounted to the housing and is operably disposed, preferably, within the plenum to draw air from the plenum and to exhaust the air outside of the housing. Filter panels are removably attached to the outer surfaces of the edges and filter material is mounted in the panels to cover the empty spaces. Magnets mounted on edges of the panels may be used as attachment devices as well as other devices for clipping the panels onto the outer surfaces of the edges of the housing. The filter material is preferably a self-charging electrostatic washable material.

U.S. Pat. No. 5,912,369 illustrates self-adhesive fibrous air filters that are universally compatible with devices that require filtered air and devices that provide filtered air. The self-adhesive air filters are fabricated from a flexible fibrous air filter blank composed of, for example, polyester batting, that is coated with an air permeable non-drying adhesive that has been vacuumed into the interstices of the fibers. A template serves as a protective cover for the non-drying adhesive and enables a user to shape and/or size the blank to configurations that are compatible with the air intake regions of the devices on which the self-adhesive air filters are to be installed.

U.S. Pat. No. 5,795,131 discloses a ceiling fan for cleaning air in a room wherein each blade of the ceiling fan has a cavity open to the top and bottom surfaces of each fan blade and a filter unit in each of the cavities but within the confines of the fan blade such that, when the ceiling fan is operated, the airflow created by the ceiling fan will be forced through the filter unit from the bottom surface through to the top surface, wherein the filter units can collect airborne particles.

U.S. Pat. No. 5,591,006 comprises a removable, washable decorative cover for each thin, flat fan blade of a paddle-type ceiling fan. The decorative cover includes a main sleeve of uninterrupted tubular shape, each end of which is open, and formed of highly elastic and expandable decorative fabric, preferably SPANDEX. The main sleeve is of sufficient elastic strength and sized substantially smaller in width than the width of the fan blade whereby, when mounted over a preselected main portion in length of the fan blade, the gripping action of the elastically stretched fabric conformingly against the surface of the main portion of the fan blade is sufficient to prevent movement therebetween when the ceiling fan is in operation. The cover may also include an end sleeve formed of the same elastic fabric and transverse width, one end of which is open, the other end of which is closed. The end sleeve conformingly fits over the distal end of the fan blade in either spaced, abutting or overlapping orientation on the distal portion of the fan blade with respect to one open end of the main sleeve. The end sleeve is likewise of sufficient elastic strength, when stretched to cover the distal portion of the fan blade, to remain stationary on the distal end of the fan blade during ceiling fan operation U.S. Pat. No. 5,562,412 consists of a fan apparatus with a filter affixed to one or more of its fan blades such that the rotating fan blades carry the filter or filters through a medium to extract pollutants.

U.S. Pat. No. 5,370,721 describes a ceiling fan filter for filtering the air in a room having a ceiling fan. The ceiling fan filter is made from at least one layer of resilient polymeric fiber filter material. Each layer has a length, a width, an upper surface, a lower surface and two side edges which extend along the length of the layer. A narrow compressed strip is formed in the filter material by compressing and heating the layer of filter material so that the filter material is fused together. The compressed strip causes an expanded thickness of the side edges to increase the effective filter surface area of the filter and gives the filter a semicircular cross-sectional shape perpendicular to the length of the filter. An adhesive layer is joined to the lower surface of the filter to attach the filter to the fan blade of a ceiling fan.

U.S. Pat. No. 4,676,721 depicts a method and device for reducing the pollution of the air in a room equipped with a ceiling fan having one or more rotating blades comprising covering at least one blade of the fan with porous dust-absorbent material whereby movement of the fan blades removes pollution from the room air.

The above cited inventions are relatively cumbersome to use and maintain, or impractical for use especially in residential locations. None of these inventions effectively deal with the problem of improving air quality while operating the fan and having a means of inexpensively and conveniently renewing the particulate matter adsorption surface.

SUMMARY OF THE INVENTION

The present invention is directed to a method and apparatus for removing pollutants from the air and thereby improving air quality. The present invention retains the comfort factors and functionality associated with the use of a fan, such as a ceiling fan, and expands its use for improved adsorption of undesirable pollutants such as particulate matter, without the use of a filter. This invention encompasses the manufacture or modification of a fan and more specifically the blades of a ceiling fan or similar air moving device with an exposed tacky surface preferably over the blade leading edge to which undesirable airborne particulate matter adhere as the blade moves, thus reducing the environmental hazard and improving air quality. It may be appreciated that a moving (or stationary) fan blade does collect some amount of pollutants. Due to its tacky substance, the present invention greatly enhances and expedites the collection process.

Those who have observed fans and more specifically ceiling fans in use can recall the collection of dust and other particulate matter collected on the fan blades, especially the leading edge. Even in what is normally thought to be a clean environment, such as a home residence, there is considerable airborne matter that collects while the fan is operating.

The present invention takes advantage of the rotating fan blade to carry and support an exposed, renewable, tacky adsorption surface to facilitate the collection and retention of the airborne particulate matter without degrading the functionality of the fan itself. As the blade rotates through the air, the particulate matter is adsorbed on the tacky surface. When the surface of the exposed tacky layer is fully or nearly fully covered with pollutants, it is removed and a new clean tacky surface is applied or exposed.

In a preferred embodiment of the invention pollutants are removed from the air. However, it may be appreciated that the principles of the invention may be more generally applied to removing pollutants from any gas.

In accordance with a preferred embodiment of the invention, a method for removing pollutants such as dust, pollen, particulate matter, germs, and the like from a gas such as air, includes:

(a) providing a fan having a fan blade having a surface and a leading edge;

(b) providing a plurality of sheets each sheet having a first side and an opposite second side, a tacky substance being disposed on the first side of each sheet, the plurality of sheets arranged in stacked multi-layer relationship wherein the second side of a sheet rests upon the first side of a next lower sheet;

(c) attaching the second side of a bottom sheet of the stack to the surface of the fan blade around the leading edge of the fan blade so that the first side of a top sheet of the stack is exposed to the gas;

(d) causing the fan blade to rotate through the gas;

(e) observing when the first side of the top sheet becomes contaminated with airborne pollutants;

(f) removing the top sheet of the stack to expose a clean uncontaminated next lower sheet in the stack; and, (g) periodically repeating steps (e) and (f).

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
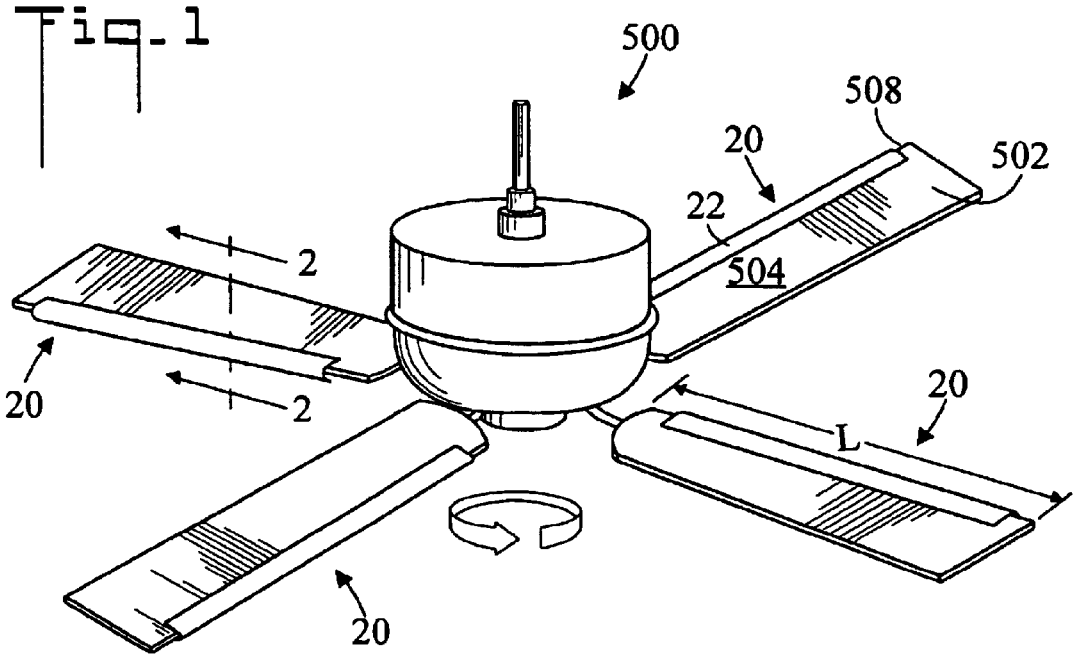
FIG. 1 is a perspective view of a fan with the air purification device of the present invention attached thereto.

Referring initially to FIG. 1, there is illustrated is a perspective view of a fan 500, such as the shown ceiling fan, with an air purification device 20 of the present invention attached thereto. Fan 500 includes a plurality of fan blades 502, each fan blade 502 having a surface including a top surface 504 and a bottom surface 506 (refer to FIG. 2), a leading edge 508, and a length L.

Figure 2:
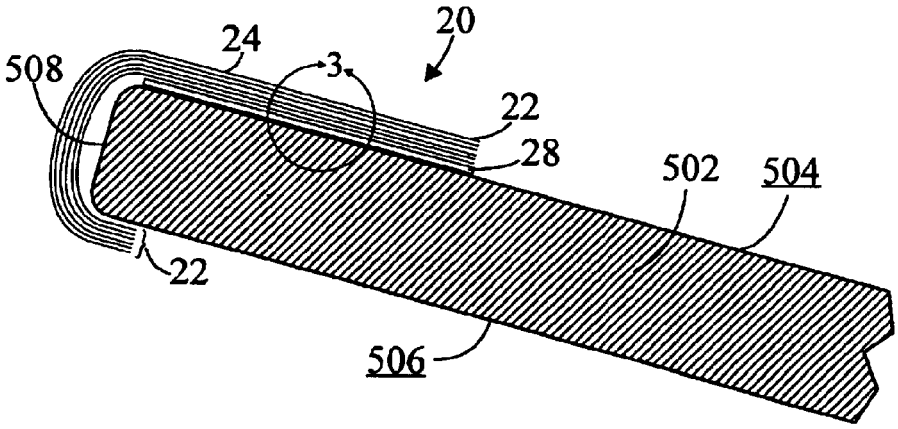
FIG. 2 is an enlarged cross sectional view along the line 2—2 of FIG. 1.
Figure 3:
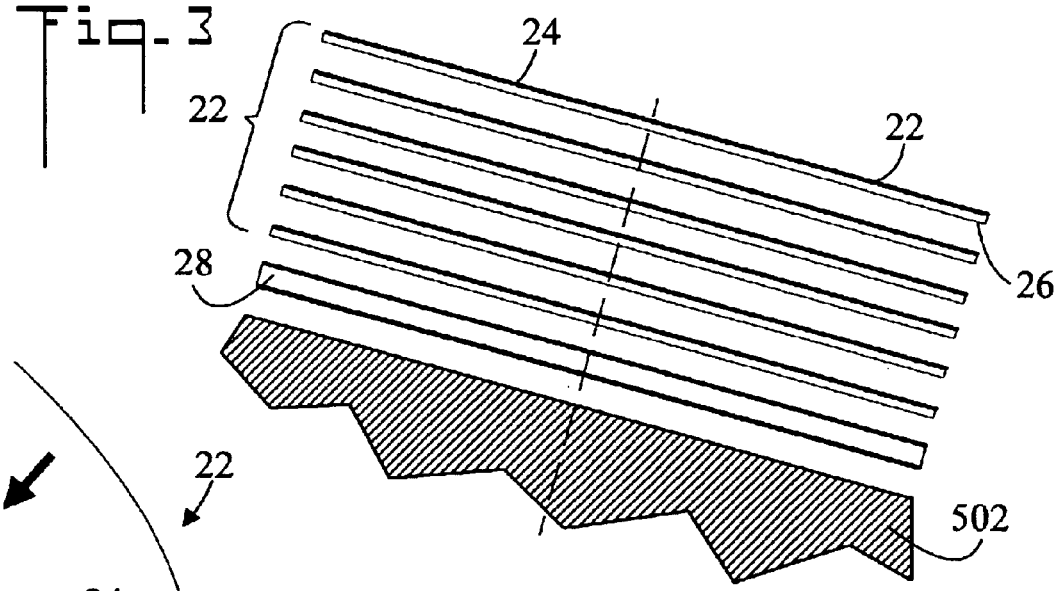
FIG. 3 is an enlarged exploded view of area 3 of FIG. 2.

FIG. 2 is an enlarged cross sectional view along the line 2—2 of FIG. 1, and FIG. 3 is an enlarged exploded view of area 3 of FIG. 2. Air purification device 20 includes at least one sheet 22 having a first side 24 and an opposite second side 26. A tacky substance (indicated by the heavy line on each sheet 22 in FIG. 3) is disposed on first side 24. In an embodiment of the invention, the tacky substance can be acrylate or elastomeric copolymer containing microspheres as disclosed in U.S. Pat. No. 3,691,140 issued to Silver on Mar. 3, 1970 and U.S. Pat. No. 3,857,731 issued to Merrill et al on Apr. 6, 1973 and assigned to Minnesota Mining and Manufacturing Co., St. Paul, Minn. While a single sheet 22 could be employed, in the shown preferred embodiment of the invention, a plurality of sheets 22 are arranged in stacked multi-layer relationship, so that as a top sheet 22 becomes contaminated with airborne pollutants it may be removed to expose an uncontaminated next lower sheet 22 below the contaminated sheet 22. It may be appreciated that in FIGS. 2 and 3 the sheets 22 are shown spaced apart for clarity. In actuality the sheets 22 are pressed together into a packet or pad (such as a note pad) wherein the tacky substance on the first side of a sheet 22 bonds that sheet 22 to the second side of the next sheet 22 in the stack.

Sheets 22 may be fabricated from a variety of thin materials such as paper, a polymer, or metal. In one embodiment of the invention, each stack or pad of sheets 22 contains 12 individual sheets, however a lesser or greater number could also be employed.

The second side 26 of sheet 22 is attachable to the surface of fan blade 502 by an adhesive and/or a mechanical connector so that first side 24 faces outward and is exposed to the air. In the embodiment shown in FIGS. 2 and 3, and double sided adhesive strip 28 attaches the second side of the bottom sheet 22 of the stack to the surface (top surface 504 shown, or bottom surface 506, refer to FIG. 7) of fan blade 502. With sheet 22 or stacked sheets 22 so attached, as the fan blade 502 rotates, first side 24 collects pollutants from the air.

Sheet 22 or stack of sheets 22 are wrappable around the leading edge 508 of fan blade 502 (also refer to FIG. 1). Also referring to FIG. 1, in an embodiment of the invention sheet 22 or stack of sheets 22 define an elongated strip which may be wrapped along at least half of the length L of fan blade 502, so that an ample amount of tacky substance is exposed to the air.

It may be appreciated that fan 500 may have a plurality of fan blades 502, and that at least one sheet 22 or a plurality of sheets 22 are attachable to each of the plurality of fan blades 502. In another embodiment of the invention, sheet 22 includes at least one of (1) a fragrance, (2) a biocide, (3) one or more colors, and (4) a decorative pattern.

Figure 4:
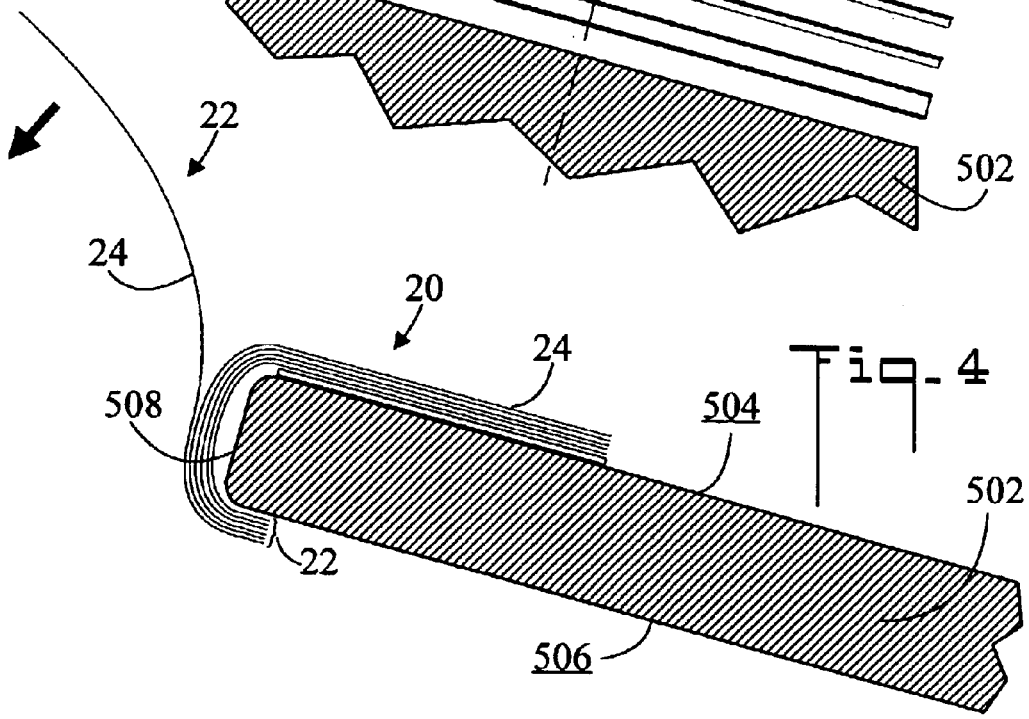
FIG. 4 is an enlarged view showing a top sheet-being removed from a multi-layer stack of sheets.

FIG. 4 is an enlarged view showing a top sheet 22 being removed from a multi-layer stack of sheets 22. The first side 24 of the top sheet 22 has become contaminated (full or nearly full) of airborne pollutants so that its capacity to adsorb pollutants is diminished. Consequently, top sheet 22 is peeled off of stack of sheets 22 to expose the next lower sheet 22 in the stack which has a fresh and uncontaminated tacky first side 24.

Figure 5:
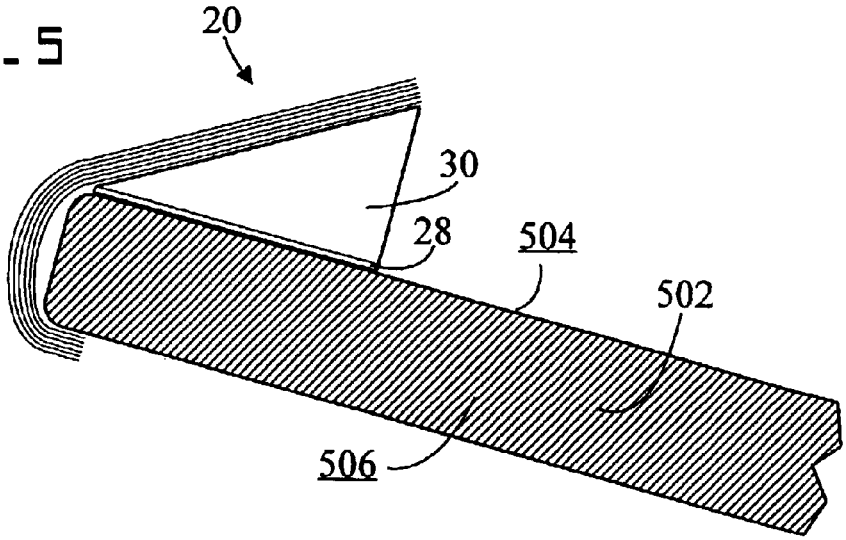
FIG. 5 is an enlarged view showing a bracket connecting a multi-layer stack of sheets to the surface of the fan blade.

FIG. 5 is an enlarged view showing a bracket 30 connecting a multi-layer stack of sheets 22 to the surface (top surface 504) of fan blade 502. Bracket 30 is disposed between sheet 22 (bottom sheet 22 of a shack of sheets 22) and the surface of fan blade 504 so that sheet 22 (stack of sheets 22) outwardly projects from the surface of fan blade 502.

Figure 6:
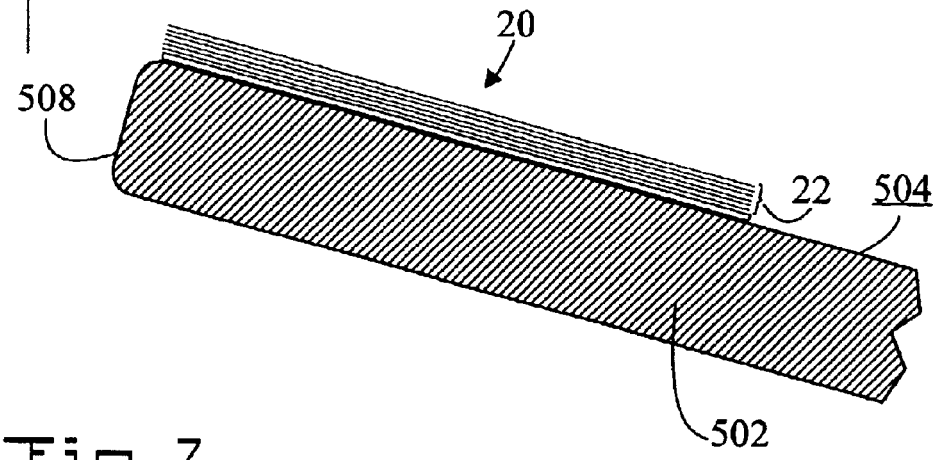
FIG. 6 is and enlarged view showing a stack of sheets attached to the top surface of the fan blade.

FIG. 6 is an enlarged view showing a stack of sheets 22 attached to the top surface 504 of fan blade 502. In this embodiment, the stack of sheets 22 does not wrap around the leading edge 508 of fan blade 502.

Figure 7:
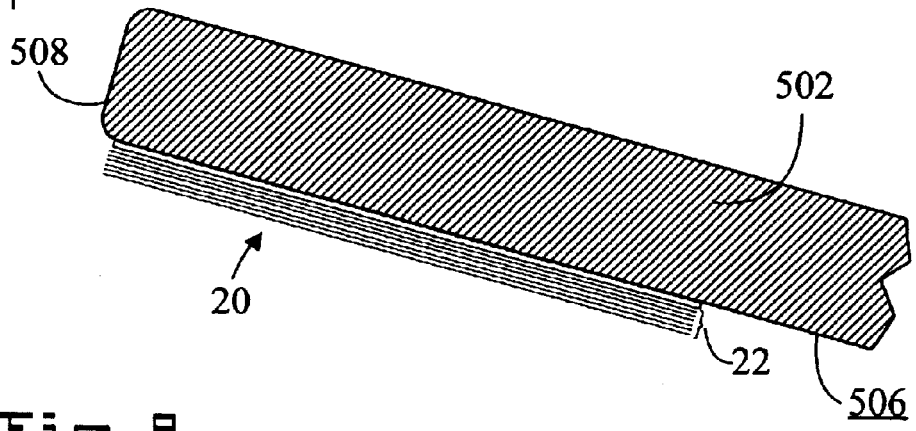
FIG. 7 is an enlarged view showing a stack of sheets attached to the bottom surface of the fan blade.

FIG. 7 is an enlarged view showing a stack of sheets 22 attached to the bottom surface 506 of fan blade 502. Again, the stack of sheets 22 does not wrap around the leading edge 508 of fan blade 502.

Figure 8:
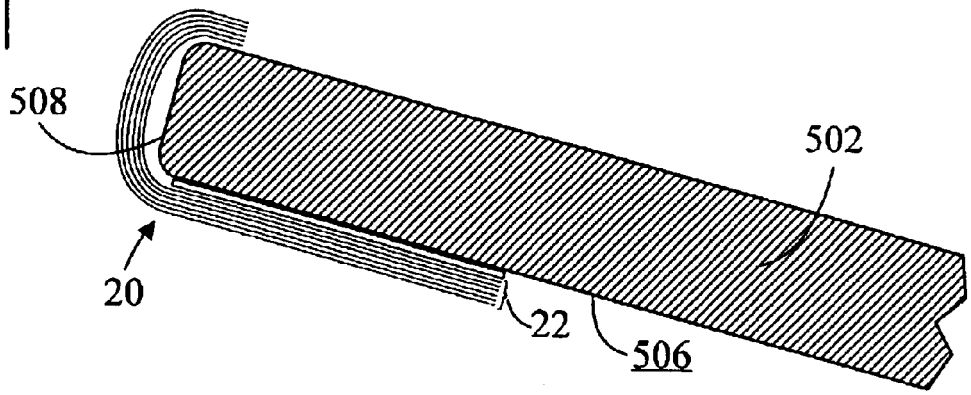
FIG. 8 is an enlarged view showing a stack of sheets attached to the bottom surface of the fan blade and wrapped around the leading edge of the fan blade; and, FIG. 9 is an enlarged exploded view showing a peel off cover being removed in order to attach a stack of sheets to the surface of the fan blade.

FIG. 8 is an enlarged view showing a stack of sheets 22 attached to the bottom surface 506 of fan blade 502 and wrapped around the leading edge 508 of the blade 502.

Figure 9:
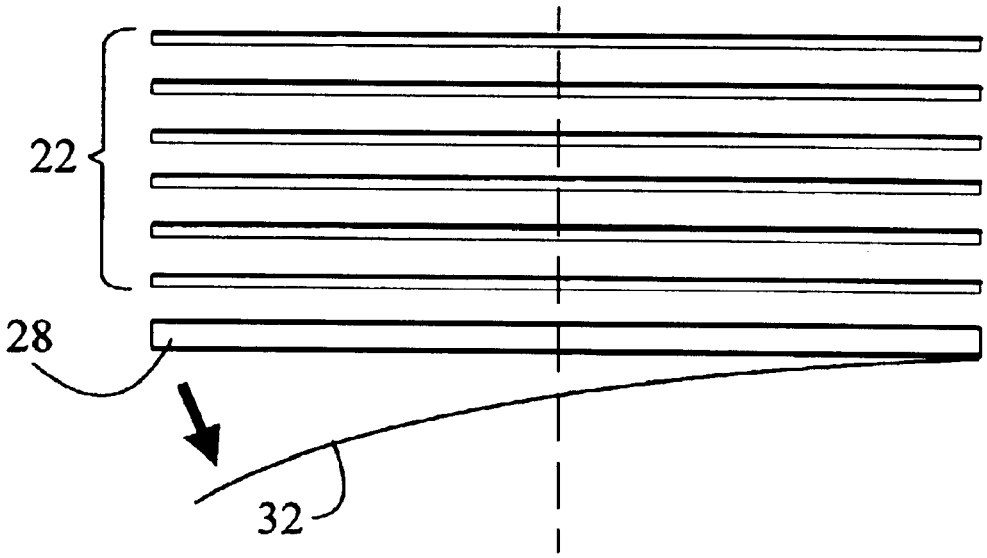

FIG. 9 is an enlarged exploded view showing a peel off cover 32 being removed in order to attach a stack of sheets 22 to the surface of fan blade 502. Peel off cover 32 attaches to the bottom side of double sided adhesive strip 28. Once peel off cover 32 is removed, the bottom of double sided adhesive strip 28 is attached to the surface of fan blade 502.

In terms of use, a method for removing pollutants from a gas, includes:

(a) providing a fan 500 having a fan blade 502 having a surface and a leading edge 508;

(b) providing a plurality of sheets 22 each sheet 22 having a first side 24 and an opposite second side 26, a tacky substance disposed on first side 24 of each sheet 22, the plurality of sheets 22 arranged in stacked multi-layer relationship wherein the second side 26 of a sheet 22 rests upon the first side 24 of a next lower sheet 22;

(c) attaching the second side 26 of a bottom sheet 22 of the stack to the surface of the fan blade 502 around the leading edge 508 of the fan blade 502 so that the first side 24 of a top sheet 22 of the stack is exposed to the gas;

(d) causing the fan blade 502 to rotate through the gas;

(e) observing when the first side 24 of the top sheet 22 becomes contaminated with airborne pollutants;

(f) removing the top sheet 22 of the stack to expose an uncontaminated next lower sheet 22 in the stack; and, (g) periodically repeating steps (e) and (f).

In a more specific embodiment of the invention, a method for removing pollutants from the air, includes:

(a) providing a fan 500 having a fan blade 502 having a surface;

(b) providing at least one sheet 22 having a first side 24 and an opposite second side 26, the sheet 22 having a tacky substance disposed of first side 24;

(c) attaching the second side 26 of the sheet 22 to the surface of the fan blade 502 so that the first side 24 of the sheet 22 is exposed to the air; and, (d) causing the fan blade 502 to rotate through the air.

The method further including:

in step (a), fan blade 502 having a leading edge 508;

in step (c), wrapping sheet 22 around the leading edge 508 of fan blade 502.

The method further including:

in step (a), the fan blade 502 having a length L;

in step (b) the sheet 22 defining an elongated strip; and, in step (c), wrapping the elongated strip along at least half of length L of fan blade 502.

The method further including:

in step (b), providing a plurality of sheets 22 arranged in stacked multi-layer relationship; and, (e) as a top sheet 22 becomes contaminated with airborne pollutants, removing the top sheet 22 to expose an uncontaminated next lower sheet 22.

The method further including:

in step (b), the tacky substance including a pressure sensitive adhesive composed of copolymer microspheres.

The method further including:

in step (c), attaching the second side 26 of sheet 22 to the surface of fan blade 502 with at least one of an adhesive and a mechanical connector.

The method further including:

in step (a), fan blade 502 having a top surface 504 and an opposite bottom surface 506;

in step (c), attaching second side 26 of sheet 24 to top surface 504 of fan blade 502.

The method further including:

in step (c), providing a bracket 30 disposed between the sheet 22 and the surface of fan blade 502 so that sheet 22 outwardly projects from the surface of fan blade 502.

The method further including:

in step (b) the fan 500 having a plurality of fan blades 502;

in step (c), attaching at least one sheet 22 to each of the plurality of fan blades 502.

The method further including:

in step (b), sheet 22 including at least one of (1) a fragrance, (2) a biocide, (3) a color, and (4) a decorative pattern.

The preferred embodiments of the invention described herein are exemplary and numerous modifications, variations, and rearrangements can be readily envisioned to achieve an equivalent result, all of which are intended to be embraced within the scope of the appended claims.

We claim:

1. A method for removing pollutants from the air, comprising:

(a) providing a fan having a fan blade having a surface;

(b) providing a plurality of sheets each sheet having a first side and an opposite second side, a tacky substance disposed on said first side of each said sheet, said plurality of sheets arranged in stacked multi-layer relationship wherein said second side of a said sheet rests upon said first side of a next lower sheet, and said plurality of sheets including a top sheet and a bottom sheet;

(c) attaching said second side of said bottom sheet to said surface of said fan blade so that said first side of said tot sheet is exposed to the air;

(d) causing said fan blade to rotate through the air;

(e) observing when said first side of said top sheet becomes contaminated with pollutants; and, (f) removing said top sheet to expose an uncontaminated next lower sheet.

2. The method of claim 1, further including:

in step (b), said tacky substance including a pressure sensitive adhesive composed of copolymer microspheres.

3. The method of claim 1, further including:

in step (c), attaching said second side of said bottom sheet to said surface of said fan blade with at least one of an adhesive and a mechanical connector.

4. The method of claim 1, further including:

in step (c), providing a bracket, said bracket disposed between said bottom sheet and said surface of said fan blade so that said top sheet outwardly projects from said surface of said fan blade.

5. A method for removing pollutants from a gas, comprising:

(a) providing a fan having a fan blade having a surface and a leading edge;

(b) providing a plurality of sheets each sheet having a first side and an opposite second side, a tacky substance disposed on said first side of each said sheet, said plurality of sheets arranged in stacked multi-layer relationship wherein said second side of a said sheet rests upon said first side of a next lower sheet;

(c) attaching said second side of a bottom sheet of said stack to said surface of said fan blade around said leading edge of said fan blade so that said first side of a top sheet of said stack is exposed to the gas;

(d) causing said fan blade to rotate through said gas;

(e) observing when said first side of said top sheet becomes contaminated with pollutants;

(f) removing said top sheet to expose an uncontaminated next lower sheet in said stack; and, (g) periodically repeating steps (e) and (f).

6. An air purification device for attachment to a fan blade having a surface, said air nurification device comprising:

a plurality of sheets each sheet having a first side and an opposite second side, a tacky substance disposed on said first side of each said sheet, said plurality of sheets arranged in stacked multi-layer relationship wherein said second side of a said sheet rests upon said first side of a next lower sheet, and said plurality of sheets including a top sheet and a bottom sheet;

each said sheet having a tacky substance disposed on said first side;

said second side of said bottom sheet attachable to the surface of the fan blade so that said first side of said top sheet is exposed to the air;

so that as the fan blade rotates, said first side of said top sheet collects pollutants from the air; and, when said top sheet becomes contaminated with airborne pollutants it may be removed to expose an uncontaminated next lower sheet.

7. An air purification device according to claim 6, further including:

said tacky substance including a pressure sensitive adhesive composed of copolymer microspheres.

8. An air purification device according to claim 6, further including:

said second side of said bottom sheet attachable to the surface of the fan blade with at least one of an adhesive and a mechanical connector.

9. An air purification device according to claim 6, further including:

a bracket disposed between said bottom sheet and the surface of the fan blade so that said top sheet outwardly projects from the surface of the fan blade.

10. An air purification device for attachment to a fan blade having a surface, a leading edge, and a length, said air purification device comprising:

a plurality of sheets each sheet having a first side and an opposite second side, said plurality of sheets arranged in stacked multi-layer relationship wherein said second side of a said sheet rests upon said first side of a next lower sheet, and said plurality of sheets including a top sheet and a bottom sheet;

each said sheet having a tacky substance disposed on said first side;

said second side of said bottom sheet attachable to the surface of the fan blade so that said first side of said top sheet is exposed to the air;

so that as the fan blade rotates, said first side of said top sheet collects pollutants from the air;

when said top sheet becomes contaminated with airborne pollutants it may be removed to expose an uncontaminated next lower sheet;

said plurality of sheets wrappable around the leading edge of the fan blade; and, said plurality of sheets defining an elongated strip which may be wrapped along at least half of the length of the fan blade.

* * * * *